US009303559B2

(12) United States Patent
Lippitt

(10) Patent No.: US 9,303,559 B2
(45) Date of Patent: Apr. 5, 2016

(54) INTERNAL COMBUSTION ENGINES

(71) Applicant: Raymond F. Lippitt, Smithfield, NC (US)

(72) Inventor: Raymond F. Lippitt, Smithfield, NC (US)

( * ) Notice: Subject to any disclaimer, the term of this patent is extended or adjusted under 35 U.S.C. 154(b) by 0 days.

(21) Appl. No.: 14/055,569

(22) Filed: Oct. 16, 2013

(65) Prior Publication Data

US 2014/0261297 A1 Sep. 18, 2014

Related U.S. Application Data

(60) Provisional application No. 61/741,781, filed on Oct. 16, 2012.

(51) Int. Cl.

*F02B 75/28* (2006.01)
*F02B 41/06* (2006.01)
*F02B 75/24* (2006.01)

(52) U.S. Cl.

CPC ..... *F02B 75/28* (2013.01); *F02B 41/06* (2013.01); *F02B 75/246* (2013.01)

(58) Field of Classification Search

CPC ..... F02B 75/28; F02B 75/282; F02B 75/246; F02B 75/24; F02B 41/06; F02D 17/00; F02D 2700/05; F02D 2700/056; F02D 2700/052

USPC ..... 123/27 R, 53.3, 51 R, 70 R, 62

See application file for complete search history.

(56) References Cited

U.S. PATENT DOCUMENTS 2,269,948 A 1/1942 Mallory
3,472,212 A 10/1969 Chamberlain
3,623,463 A 11/1971 De Vries
3,880,126 A 4/1975 Thurston et al.
4,170,970 A 10/1979 McCandless (Continued)

FOREIGN PATENT DOCUMENTS

GB 301677 12/1928

OTHER PUBLICATIONS

Split Cycle Engine, obtained from url: <http://en.wikipedia.org/wiki/Split_cycle_engine> on Apr. 26, 2012.

(Continued)

*Primary Examiner* — Lindsay Low
*Assistant Examiner* — Kevin Lathers
(74) *Attorney, Agent, or Firm* — Pillsbury Winthrop Shaw Pittman, LLP

(57) ABSTRACT

An engine including at least two piston and cylinder assemblies that, when operating with a fuel savings cycle, establish at the end of the simultaneous compression strokes a charge of compressed air in one cylinder of one assembly and a charge of compressed air fuel mixture in the other cylinder of the other assembly. When the air fuel mixture is ignited, the high pressure conditions in the other cylinder are immediately communicated through a passage to the one cylinder to accomplish a double expansion during the simultaneous power drive strokes thus using much of the pressure energy before exhaust occurs by the pistons themselves. The improvement comprises changing the other assembly which has the charge of compressed air fuel mixture therein between the two piston and cylinder assemblies in a predetermined pattern as, for example, an operative alternation between the two piston and cylinder assembles.

16 Claims, 8 Drawing Sheets

(56) References Cited

U.S. PATENT DOCUMENTS

| | | | | |
|---|---|---|---|---|
| 4,172,434 | A | 10/1979 | Coles | |
| 4,250,850 | A | 2/1981 | Ruyer | |
| 4,565,167 | A * | 1/1986 | Bryant | 123/70 R |
| 5,022,353 | A | 6/1991 | Kamamura | |
| 5,562,086 | A * | 10/1996 | Asada et al. | 123/568.21 |
| 6,209,495 | B1 | 4/2001 | Warren | |
| 6,338,328 | B1 | 1/2002 | Mower et al. | |
| 6,363,907 | B1 | 4/2002 | Arai et al. | |
| 6,978,204 | B2 | 12/2005 | Surnilla et al. | |
| 6,988,471 | B2 | 1/2006 | Chang | |
| 6,994,057 | B2 | 2/2006 | Loth et al. | |
| 7,080,615 | B2 | 7/2006 | Shinogle | |
| 7,219,634 | B2 | 5/2007 | Hitomi et al. | |
| 7,383,797 | B2 | 6/2008 | Tour | |
| 7,434,550 | B2 * | 10/2008 | Hofbauer | 123/51 R |
| 7,578,267 | B2 | 8/2009 | Hofbauer et al. | |
| 7,685,988 | B2 | 3/2010 | Almkvist et al. | |
| 7,823,547 | B2 | 11/2010 | Forner, Sr. et al. | |
| 7,954,472 | B1 | 6/2011 | Sturman | |
| 7,958,864 | B2 | 6/2011 | Sturman | |
| 8,006,656 | B2 | 8/2011 | Branyon et al. | |
| 8,051,811 | B2 | 11/2011 | Phillips | |
| 8,132,546 | B2 | 3/2012 | Surnilla | |
| 8,156,904 | B2 | 4/2012 | Giannini et al. | |
| 8,443,769 | B1 * | 5/2013 | Lippitt | 123/70 R |
| 8,899,193 | B2 | 12/2014 | Lippitt et al. | |
| 9,026,339 | B1 | 5/2015 | Sturman | |
| 2005/0022755 | A1 | 2/2005 | Hitomi | |
| 2006/0102124 | A1 | 5/2006 | Calderwood | |
| 2008/0029057 | A1 | 2/2008 | Hergart et al. | |
| 2009/0145396 | A1 | 6/2009 | Almkvist et al. | |
| 2009/0183699 | A1 | 7/2009 | Sturman | |
| 2010/0050978 | A1 | 3/2010 | Hofbauer | |
| 2010/0056327 | A1 | 3/2010 | Hofbauer | |
| 2010/0229806 | A1 | 9/2010 | Kemeny | |
| 2010/0229836 | A1 | 9/2010 | Hofbauer et al. | |
| 2010/0229838 | A1 * | 9/2010 | Sturman | 123/525 |
| 2010/0284824 | A1 | 11/2010 | Hippen et al. | |
| 2010/0308685 | A1 | 12/2010 | Hippen et al. | |
| 2010/0326394 | A1 | 12/2010 | Hofbauer | |
| 2011/0022289 | A1 | 1/2011 | Hofbauer | |
| 2011/0057049 | A1 | 3/2011 | Hofbauer et al. | |
| 2011/0215575 | A1 | 9/2011 | Hofbauer et al. | |
| 2011/0220080 | A1 | 9/2011 | Meldolesi et al. | |
| 2011/0241473 | A1 | 10/2011 | Hippen et al. | |
| 2011/0251773 | A1 | 10/2011 | Sahandiesfanjani et al. | |
| 2012/0073538 | A1 | 3/2012 | Hofbauer | |
| 2012/0085302 | A1 | 4/2012 | Cleeves | |
| 2012/0085305 | A1 | 4/2012 | Cleeves et al. | |
| 2013/0298888 | A1 * | 11/2013 | Fiveland | F02B 33/22 123/70 R |
| 2015/0136069 | A1 | 5/2015 | Lippitt | |
| 2015/0136083 | A1 | 5/2015 | Lippitt | |
| 2015/0142291 | A1 | 5/2015 | Lippitt et al. | |
| 2015/0167548 | A1 | 6/2015 | Lippitt | |

OTHER PUBLICATIONS

Scuderi Engine, obtained from url: <http://en.wikipedia.org/wiki/Scuderi_Engine> on Apr. 26, 2012.

EcoMotors International Technology, obtained from url: <http://www.ecomotors.com/technology> on May 10, 2012.

* cited by examiner

INTERNAL COMBUSTION ENGINES

CROSS-REFERENCE TO RELATED PATENT APPLICATION

The present application claims benefit to U.S. Provisional Application Ser. No. 61/741,781 filed Oct. 16, 2012, the entirety of which is incorporated herein by reference.

FIELD OF THE INVENTION

This invention relates to internal combustion engines and more particularly to internal combustion engines and methods of operating the engines with a new fuel saving cycle.

BACKGROUND OF THE INVENTION

The present economic condition is particularly bad with respect to gasoline and diesel fuel for cars and heavy trucks. While efforts are being made to provide hybrid automobiles that can operate on rechargeable batteries at least part of the time, nevertheless most still have engines as well that must rely upon gasoline or diesel fuel. The need to make engines more efficient still exists particularly because of rising gasoline and diesel fuel costs.

BRIEF DESCRIPTION OF THE INVENTION

The above identified application describes a computer for controlling the injectors when the engine forms the propulsion means of an automotive vehicle in accordance with sensed coordination of the vehicle operation, one example of which is when the cruise control is actuated. The disclosure implies that when a continuing condition is sensed, the operation of the injectors simply continues as they are started.

An aspect of the present invention is based upon the principle that when a continuing condition is sensed, rather than continuing the operation of the injectors in the manner in which they were started, it may preferable to change which one of the two piston and cylinder assemblies constitutes the one cylinder which has the ignitable fuel mixture therein. The change may be in accordance with a predetermined pattern, such as, an operative alternation between the two piston and cylinder assemblies. An advantage of operating in accordance with the principles of the present invention is that the heat of continuous operation in the fuel saving mode is evened out between the two piston and cylinders involved rather than being concentrated in one piston and cylinder assembly.

The invention can be embodied in engines in which the injections made by the injectors cause the ignition (as in conventional compression ignition) or in which the injections are made during simultaneously intake strokes and ignition is made by a spark ignition system. In the case of spark ignition, under normal mode operation the ignition of the second air fuel charge is ignited by a high pressure flame resulting from the ignition in the first cylinder extending through the passage.

The engines embodying the principles of the present invention can be operated either on a four cycle basis or a two cycle basis.

The invention is most easily applicable to engines of the opposed piston type. A particularly efficient embodiment utilizes the opposed pistons in one cylinder type of setup utilized in the new Eco Motors (located in Allen Park, Mich.) engine. The Eco Motors set up includes two cylinders disposed on opposite sides of a central portion of the crankshaft. The central portion of the crankshaft is connected to a pair of connecting rods so as to move a pair of pistons one within each cylinder in two stroke cycles out of phase 180° with respect to one another. An opposing piston is mounted in the cylinders, each of which is constrained to move in a cooperating two stroke cycle by a pair of parallel elongated connecting rods pivoted to an opposing piston and to the crankshaft so as to be 180° out of phase with respect to one another.

The Eco Motors engine is advertised as being modular. A dual modular engine includes two modular engines connected together by a clutch assembly. The dual modular engine is comparable to the eight cylinder engines capable of operating on four cylinders only to save fuel. Thus, instead of four non-fueled piston and cylinder assemblies simply going through the motions, the clutch makes it possible to render one modular engine totally inoperable.

One of the objects of the present invention is to reconfigure the Eco Motors dual modular with clutch engine (or another similar such engine) and achieve selective normal operation and fuel saving operation in an improved new cycle way so that the reconfiguration saves parts and the new cycle is more efficient when compared with the dual modular Eco Motors engine and its operation in fuel saving mode.

In accordance with the principles of the present invention the above objective is achieved by abandoning the modular idea and mounting two side by side cylinders on opposite sides of a single central crank shaft so that in each pair of cylinders a pair of opposed pistons move simultaneously through the same two stroke cycle. In this way the events occurring in each pair of side by side cylinders are the same but 180° out of phase with one another. The fuel saving mode is accomplished simply by providing a passage between each pair of side by side cylinders at the central combustion chamber areas, and then reprogramming the computer operated fuel injectors so that one of the two injectors for the two cylinders does not inject instead of both injecting as in normal operation. Consequently, in fuel saving mode the one cylinder which receives an injection when ignited will immediately communicate the resulting high pressure conditions through the passage to the other cylinder to raise the charge of air therein at compression pressure. With the pressure created by the one ignition acting on two pistons to effect simultaneous power drive strokes of two pistons a double working pressure expansion occurs, thus utilizing much of the pressure energy that usually is dumped to exhaust.

Others objects, features and advantages of the present disclosure will become apparent from the following detailed description, the accompanying drawings, and the appended claims.

DETAILED DESCRIPTION OF THE INVENTION

Figure 1:
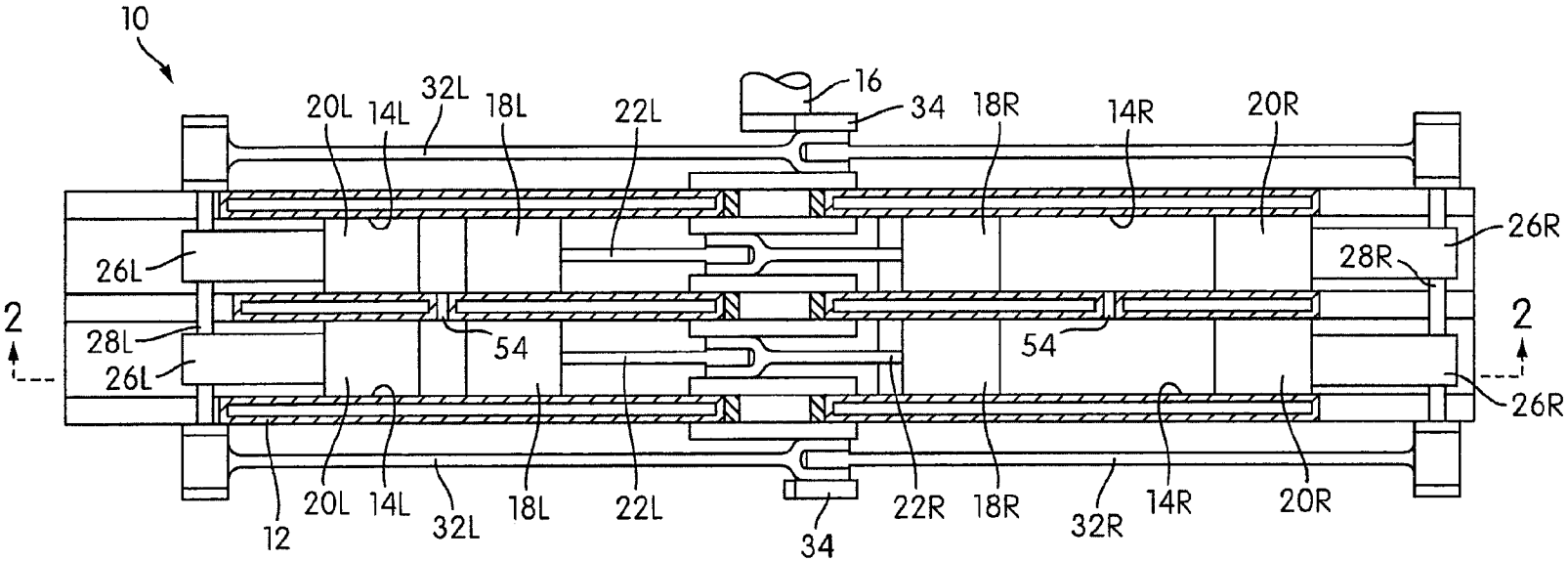
FIG. 1 is a horizontal sectional view of an internal combustion engine embodying the principles of the present invention.
Figure 2:
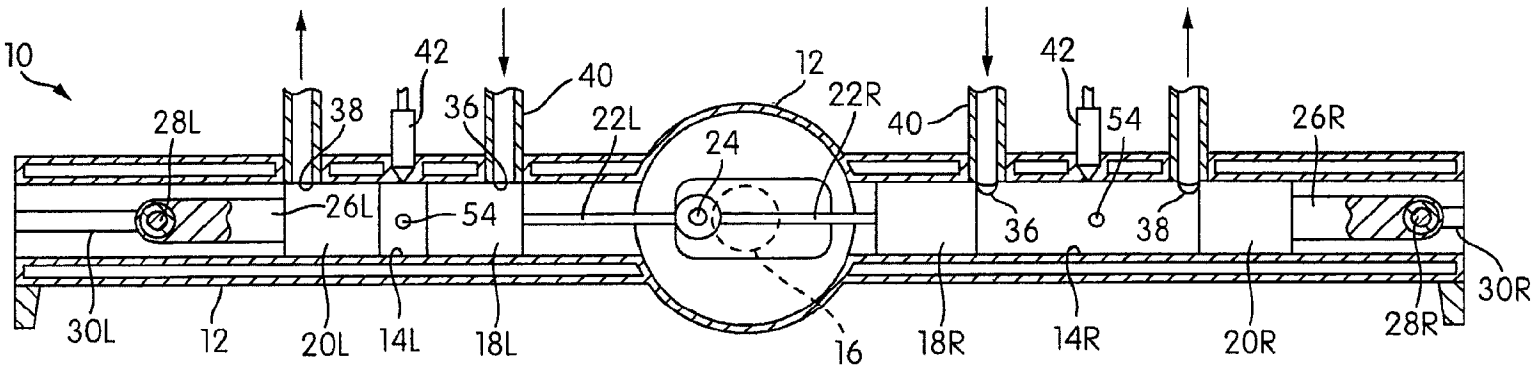
FIG. 2 is a section view taken alone the line 2-2 of FIG. 1.

The subject matter herein may be used as an improvement to the invention(s) in U.S. application Ser. No. 13/475,253, filed May 18, 2012, the entirety of which is incorporated herein by reference. Referring more particularly to the drawings, there is shown in FIGS. 1 and 2 there of an internal combustion engine, generally indicated at 10, that embodies the principles of the present invention.

The engine 10 includes a main frame structure 12 shown illustratively as one piece in the drawings. In actuality, the frame may be made up of many conventional pieces. In the illustrative one piece embodiment shown the frame structure defines pairs of side by side cylinders 14L and 14R disposed in general alignment on opposite sides of an output crank shaft 16. Mounted within the pairs of cylinders 14L and 14R are pairs of opposed pistons 18L and 20L and 18R and 20R respectively.

The pair of pistons 18L are slidably sealingly mounted in the pair of cylinders 14L for simultaneous movements together toward and away from the crank shaft 16 by a pair of connecting rods 22L pivotally connected at one of their ends to the pair of pistons 18L (as by wrist pins not shown) with their opposite ends rotatably mounted on two aligned interior cranks 24 of the crank shaft 16.

The pair of pistons 18R are slidably sealingly mounted in the pair of cylinders 14 R for simultaneous movements together toward and away from the crank shaft 16 by a pair of connecting rods 22R pivotally connected at one of their ends to the pair of pistons 18R (as by wrist pins not shown) with their opposite forked ends rotatably mounted on the two interior cranks 24.

The pair of pistons 20L are slidably sealingly mounted in the pair of side by side cylinders 14L outwardly of the pair of pistons 18L therein for simultaneous movements toward the pistons 18L as the pistons 18L move away from the crankshaft 16 and away from the pistons 18L as the pistons 18L move toward the crank shaft 16.

The simultaneous movements of the pair of pistons 20L is accomplished by a pair of fixed rods 26L extending outwardly of the pair of pistons 20L and having a shaft 28L extending transversely therethrough so as to be relatively pivoted with respect to the piston rods 26L about the axis of the shaft 28L. The shaft 28L moves within three axially spaced slots 30L formed in the adjacent end of the frame structure 12 as shown, the central portion of the shaft 28L extending between the spaced connecting rods 26L slides in the central slot 30L and opposite ends of the shaft 29L extend outwardly of the rods 26L through the outer two slots 30L and then beyond the adjacent frame structure 12.

Pivoted to the outwardly extending ends of the shaft 28L are one of the ends of a pair of exterior connecting rod's 32L. The pair of exterior connecting rods 32L extend inwardly toward the crank shaft 16 and have their inner ends rotatably connected to two exterior cranks 34 on the opposite ends of the crank shaft 16 transversely outwardly of the adjacent frame structure 12.

The pair of outer pistons 20R are related to the pair of inner pistons 18R and move simultaneously together and away from one another by a similar assembly of components including piston rods 26R, shaft 28R moving in slots 30R and a pair of exterior connecting rods 32R having their inner ends rotatably connected to the cranks 34 of the crank shaft 16 and their outer ends pivotally connected with outer ends of the shaft 28R.

It can be seen from the connection of the connecting rods 22L and 22R, between the crank shaft 16 and inner pairs of pistons 18L and 18R and the connection of the exterior connecting rods 32L and 32R between the crank shaft 16 and the outer pairs of pistons 20L and 20R, the pairs of pistons 18L and 20L move simultaneously trough two stroke repetitive cycles each including (1) a compression stroke wherein the pairs of pistons 18L and 20L move from an outer limiting position spaced widely apart toward one another into inner limiting position spaced apart but almost together and (2) a power drive stroke wherein the pairs of pistons 18L and 20L move from the inner limiting position to the outer limiting position away from one another.

The pairs of pistons 18R and 20R have a similar two stroke repetitive cycle. However, since they are connected to the same cranks of the crank shaft 16 (i.e., at the same crank axis), the two stroke cycle thereof is displaced 180° from the two stroke cycle of the pairs of pistons 18L and 20L. Stated differently, the pistons 18L and 20L move through a compression stroke while the pistons 18R and 20R move through a power drive stroke and when the pistons 18L and 20L move through a power drive stroke the pistons 18R and 20R move through a compression stroke.

The pistons 18L-20L and 18R-20R are moved through repetitive out of phase two stroke cycles during each revolution of the crankshaft 16 because during the time when the pistons are near the outer limiting positions a flow of air under pressure is made to pass into one end of each pair of side by side cylinders 14L or 14R through an inlet opening 36 in each cylinder 14 and out an outlet opening 38 at the opposite end of each cylinder. Conversely, the pistons in the other cylinders are in the inner limiting position and the openings 36, 36 are closed off.

Figure 3:
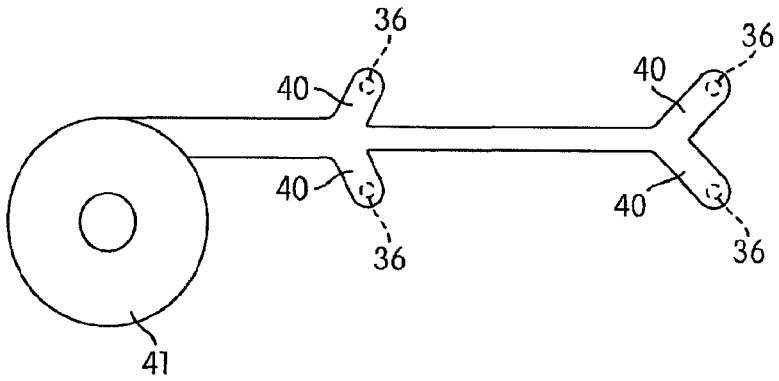
FIG. 3 is a schematic view showing a pressurized air intake system.

FIG. 3 illustrates schematically how a pump 41 (suitable to be driven by the output shaft 16) feeds a pressurized flow of air through tubes to each inlet opening 36 when the inlet openings and outlet openings 38 are opened in accordance with known practice by the movement of the associated pistons 18 or 20 thereby near the end of the power drive strokes thereof.

As the pistons 18 and 20 move through the initial portion of their compression stroke, the pressurized air that has moved into the cylinders 14 is trapped therein because the pistons move past the openings 36 and 38 in the opposite direction to close them. The trapped air is then pressurized as pistons 18 and 20 move together in their compression stroke.

In the embodiment shown, the compression ratio is chosen so that when the pistons 18 and 20 reach near or at their inner limiting positions, the pressure and temperature conditions of the air is such that an injection of fuel also causes compression ignition to occur.

As shown in the drawings, there is a fuel injector 42 carried by the frame structure 12 in association with each cylinders 14 is positions so that its nozzle enters within the cylinder 14 in the combustion chamber space between the pistons 18 and 20 when in their inner limiting positions.

Figure 4:
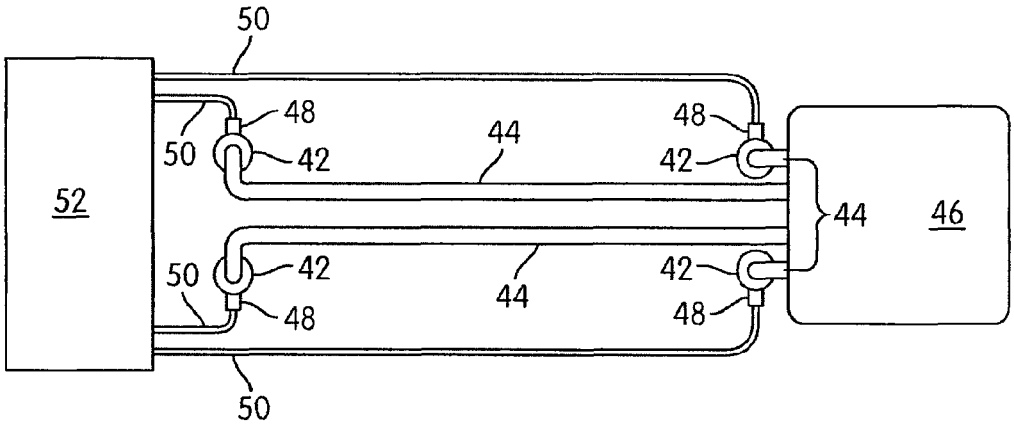
FIG. 4 is a schematic view showing a computer controlled fuel injection system.

FIG. 4 illustrates schematically the four fuel injectors 42 having high pressure fuel lines 44 leading thereto from a conventional source, indicated schematically by the numeral 46. The fuel injectors 42 are constructed and arranged with electrically operated valves shown schematically at 48 which open to inject fuel into the cylinder 14 and close to stop injection. Electrical lines 50 are shown schematically connected to the valves 48. The lines 50 are shown connected to a computer, shown schematically by the numeral 52. The lines 50 transmit signals to the valves 48 to open and close them with the interval between the opening signal and the closing signal determining the amount of fuel injected.

Also, each pair of side by side cylinders 14 are made to communicate with one another by a passage 54 extending between each side by side pair at central portions thereof opposite the injectors 42. The computer 52 is programmed to selectively cause one injector 42 associated with one cylinder of each pair of side by side cylinders 14 to inject zero fuel or in other words not to inject.

The computer 52 normally operates the four injectors 42 to inject the same amount of fuel into both of each same-side pair of cylinders 14L or 14R to cause ignition to occur therein bearing in mind that the injection in the one pair of cylinders 14L or 14R is 180° out of phase with other pair of cylinders 14L or 14R. It will be noted that simultaneous ignition occurs in both cylinders of a pair so that passage 54 is not significantly in play as the high pressure created by ignition in both cylinders 14 will act on both pairs of opposed pistons 18 and 20.

When the computer 52 signals one of the two injectors 42 of each same-side pair of cylinders 14 not to inject, the ignition of the fuel in the other that receives fuel causes high pressure to rise in that cylinder 14, which high pressure is immediately communicated by the passage 54 to the other cylinder 14 at the lower compression pressure so that both pairs of opposed pistons 18 and 20 are moved through power drives strokes together. In effect, the single ignition results in double working expansion of the pressure energy created.

This fuel saving mode of operation which can be selected by the computer 52 reduces the fuel used by the engine in half just as is done with the V-8 that can selectively operate on four cylinders or the dual modular Eco Motor with clutch. The fuel saving mode of the present invention operates all moving components of the engine with a more efficient use of the lesser fueled ignitions.

In order for the computer 52 to select the fuel saving mode in automobile usage, the function of the automobile must be electrically sensed and transmitted to the computer 52. Known sensors exist in automobiles equipped with the V-8 Engine that operates fuel savings with four cylinders. For example, normal operation is selected when the gas pedal movement to accelerate the car is sensed and fuel saving mode is selected when brake pedal movement is sensed. Cruise control when sensed to be on could be used to select fuel saving mode. Sensing motor rotation without wheels turning (idling) would select fuel saving mode.

Referring again more particularly to the drawings there is shown in FIGS. 5-9 thereof a spark ignite internal combustion engine, generally indicated at 110, embodying the principles of the present invention. The engine 110 includes a frame structure, generally indicated at 112, which is shown, in FIG. 5 as being of three piece construction including a main body structure 114 with a head structure 116 on opposite ends of the main body structure 114. It will be understood that the three piece construction is illustrative only and that the frame structure 114 would be actually constructed in many pieces in accordance with known practice.

Figure 5:
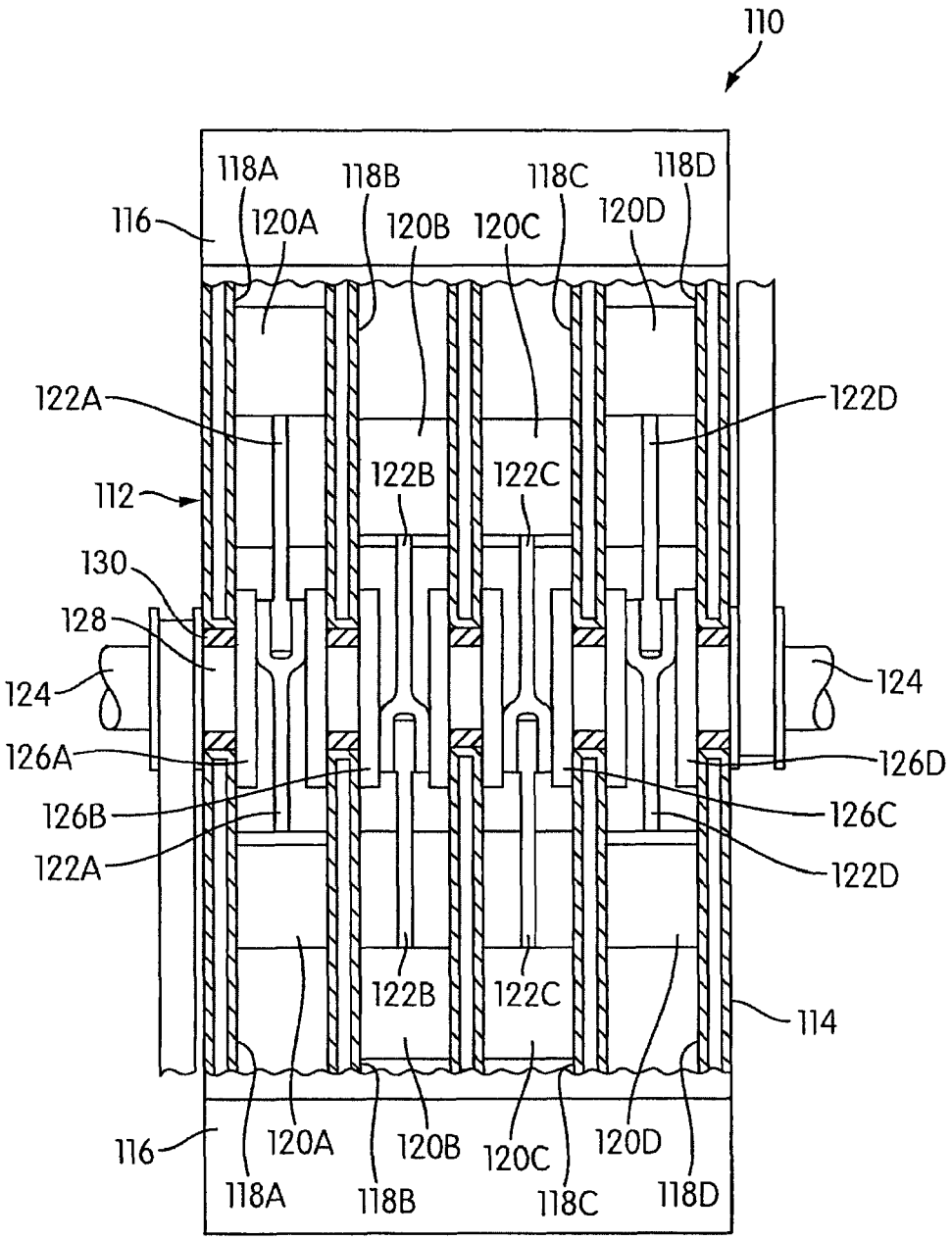
FIG. 5 is a top plan view of another engine embodying the principles of the present invention with parts broken away and shown in horizontal section for purposes of clearer illustration.
Figure 6:
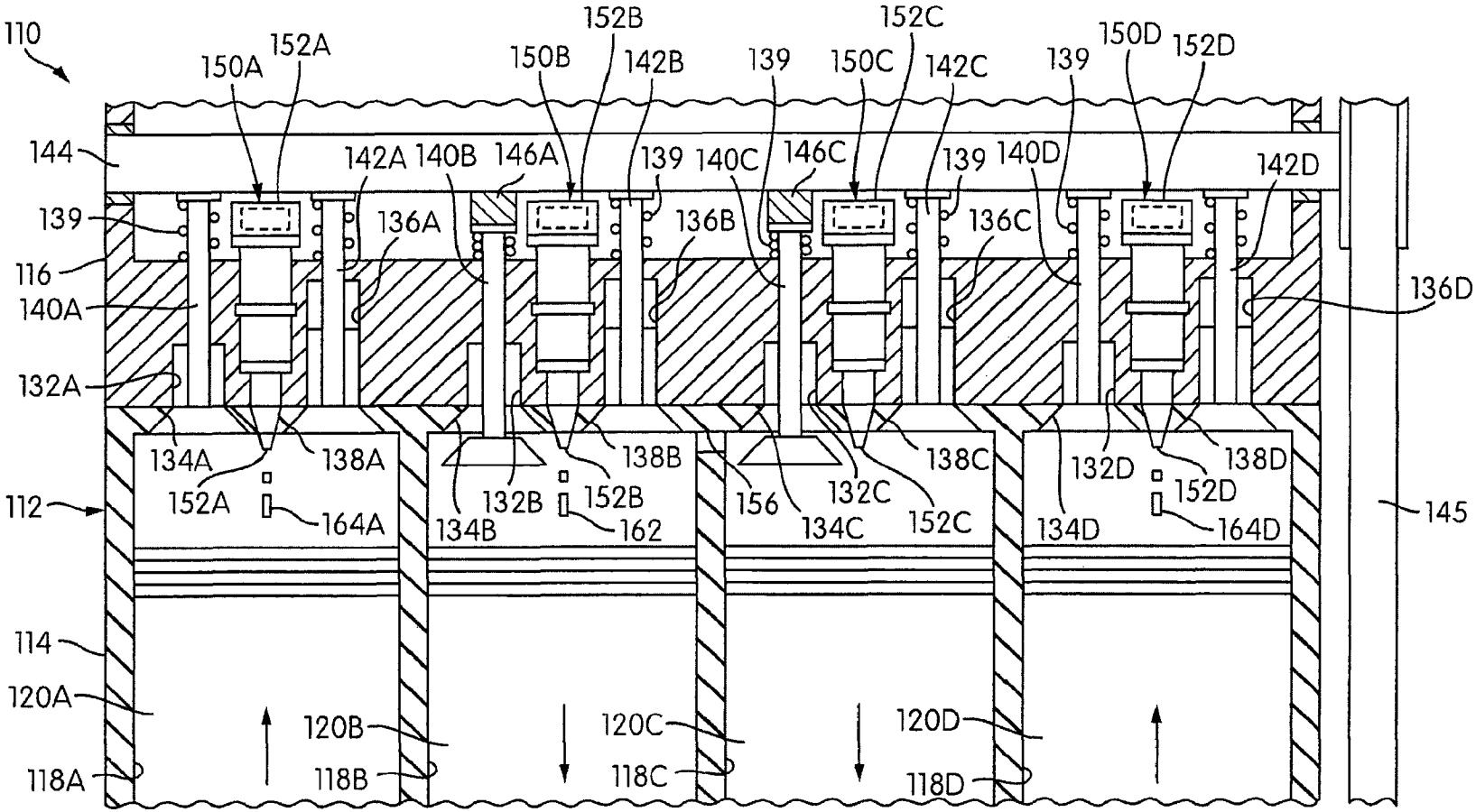
FIG. 6 is an enlarged horizontal sectional view of one end portion of the engine of FIG. 5 showing the position of the parts in mid stroke.
Figure 7:
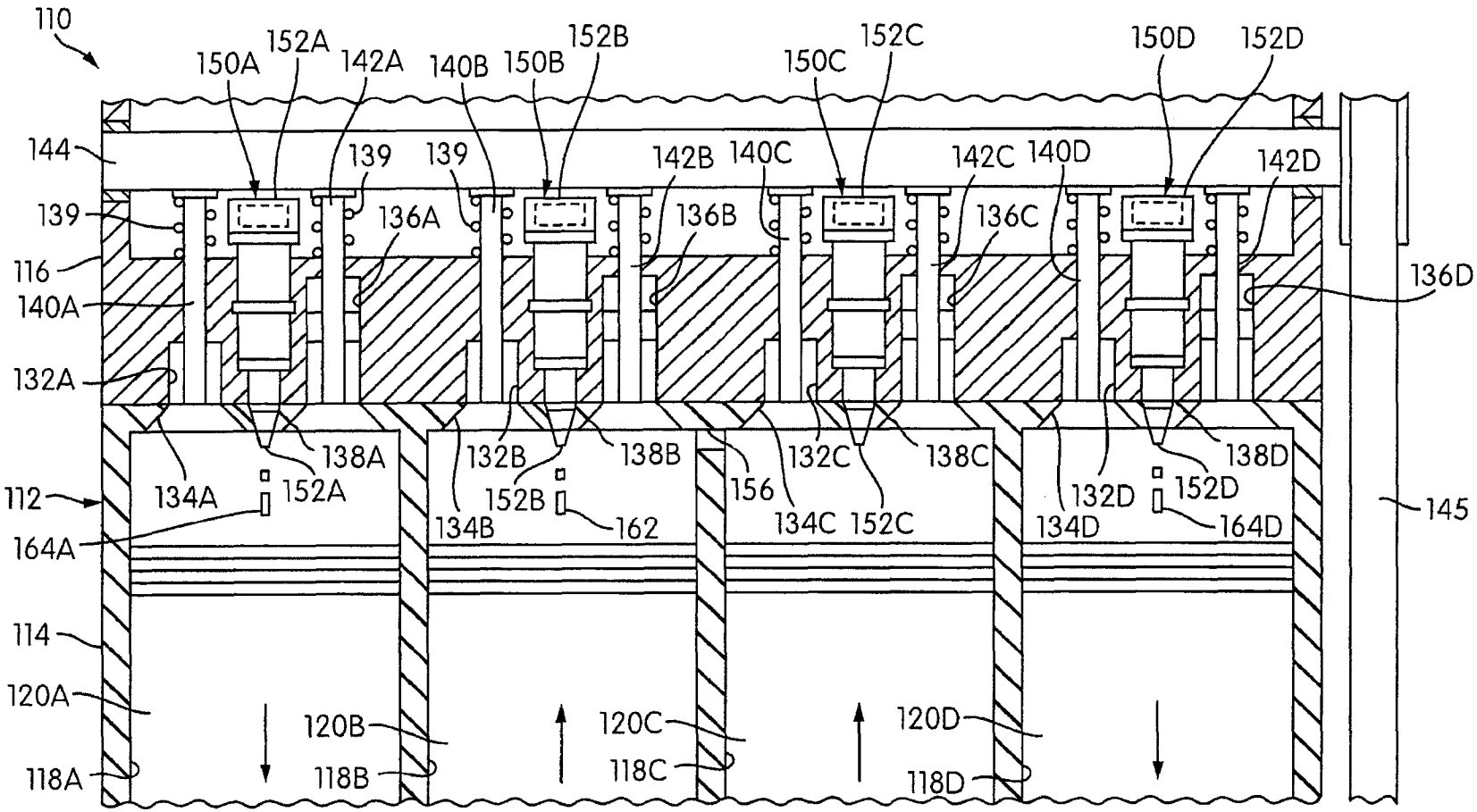
FIG. 7 is a view similar to FIG. 6 showing the position of the parts after a 180° turn of the output shaft from the position show in FIG. 6 shaft.
Figure 8:
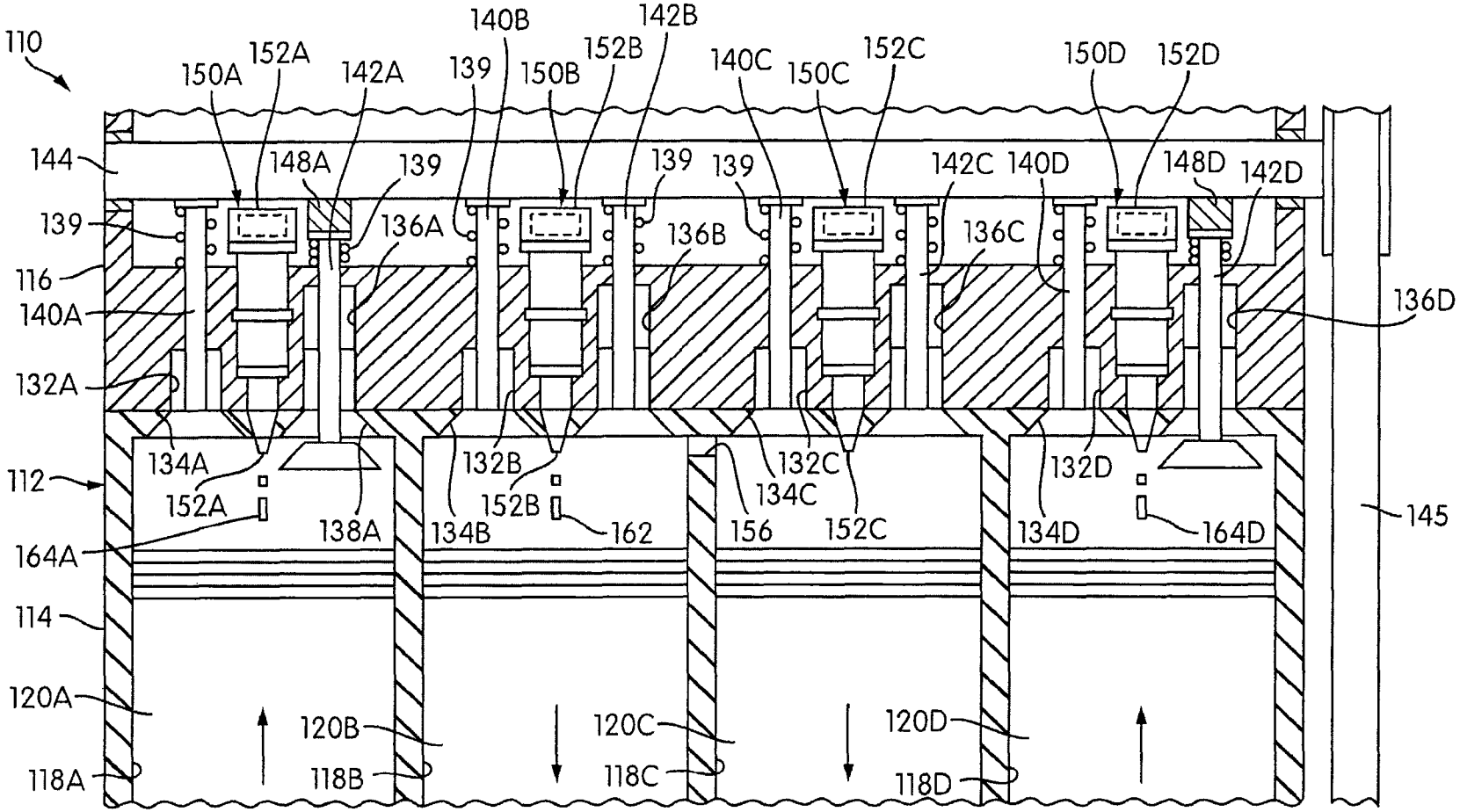
FIG. 8 is a view similar to FIG. 5 showing the position of the parts after another 180° turn of the output shaft from the position shown in FIG. 7.
Figure 9:
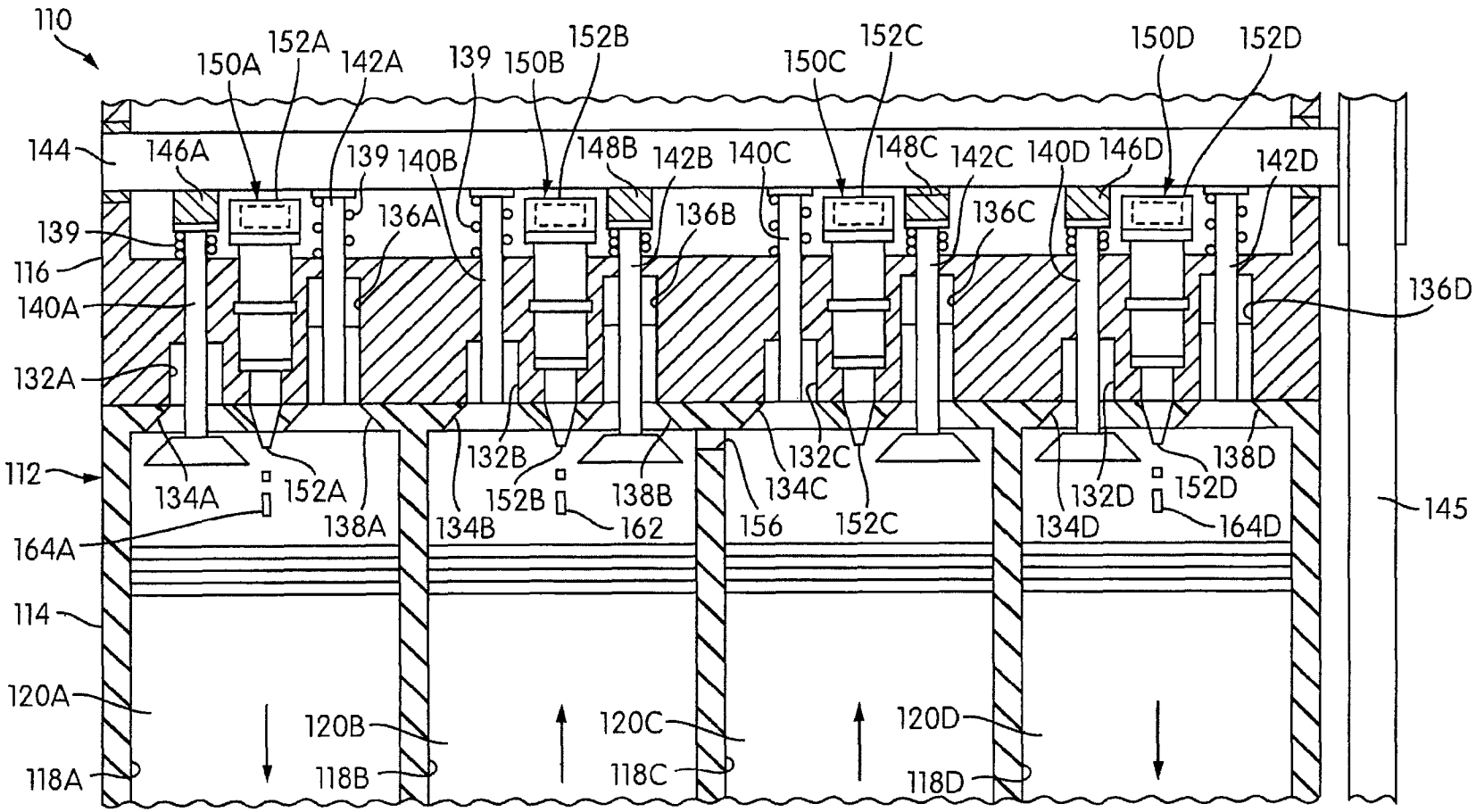
FIG. 9 is a view similar to FIG. 5 showing the position of the parts after another 180° turn of the output shaft from the position shown in FIG. 8.

As shown in FIG. 5, the engine 110 is opposed piston configuration having opposed duplicate operative piston and cylinder assemblies connected to opposite sides of a centrally located output crankshaft 124 so that the assembles are 180° out of phase with respect to one another.

Since the piston and cylinder assemblies are duplicates of one another, a description of one will suffice to give an understanding of both, keeping in mind that they are 180° out of phase with respect to one another.

Referring now more particularly to the drawings there thereof as best shown in FIGS. 5-8, the body structure 114 includes structures defining four inline cylinders, designated by the numeral 118 with added letters A through D respectively. Slidably sealingly mounted in the four cylinders 118 are four pistons, designated by the numeral 120 with added letters A through D respectively.

Each piston 120 has one end of a connecting rod 122 pivotally connected thereto as by a conventional wrist pin (not shown). The opposite end of each connecting rod 122 is rotatably connected to the output shaft 124. The output shaft 124 is formed with four U-shaped crank portions, designated by the numeral 126 with added letters A through D respectively, spaced apart by straight bearing portions 128 journalled in bearings suitably mounted on the body structure 114. The crank portions 126A and 126D are oriented to extend outwardly from the adjacent bearing portions 128 in the same directions and the crank portions 126B and 126C are oriented to extend outwardly from the adjacent bearing portions 128 in the same direction but disposed 180° from the direction of extent of the crank portions 128.

Each connection between the ends of the piston rods 122 with the output crank shaft 124 is accomplished by journaling an end of a respective piston rod 122 rotationally on the right of a respective U-shaped crank portion 126. As a result of the orientation of the crank portions 126 and the connection of the piston rods 122 rotatably connected thereto and to the pistons 120 for pivotal movement, the pistons 120A and 122D will move together through simultaneous strokes in one direction while the pistons 120B and 120C move together through simultaneous strokes in an opposite direction.

The head structure 116 which defines an end wall closure for all four cylinders 118 has formed therein an air supply passage designated by the numeral 132 with added letters A through D respectively which communicates with the four cylinders 118 through four inwardly facing valve seat defining inlet openings designated by the numeral 134 with added letters A through D respectively. The head structure 116 also has formed therein four exhaust passages designated by the numeral 136 with added letters A through D respectively which communicate with the four cylinders 118 through four inwardly facing valve seat defining outlet openings, designated by the numeral 138 with added letters A through D respectively.

Mounted on the head structure 116 for movements toward the inlet openings 134 into sealing relation thereto and away from the inlet openings 134 into opening relation thereto are four stem operated poppet valves, designated by the numeral 140 with added letters A through D respectively. Also mounted on the head structure 116 for movements toward the outlet openings 138 into sealing relation thereto and away from the outlet openings 138 into opening relation thereto are four stem operated poppet valves, designated by the numeral 142 with added letters A through D respectively.

The poppet valves 140 and 142 are spring biased to move into sealing relation with their associated openings 134 and 138 by conventional springs 139 and are moved against the spring bias into opening relation to their associated openings 134 and 138 by a camshaft 144 rotatably mounted on the head structure 116 in a position overlying the valves 140 and 142 and the openings 134 and 138. The camshaft 144 is rotationally moved at a rotational speed one half the rotational speed of the output shaft 124 by a conventional rotational movement transmitting mechanism 145 connected between the output shaft 124 and the camshaft 144 so that during every two revolutions of the output shaft 124 the camshaft 144 is driven thereby through one revolution. In this way, the camshaft 144 is able to move the valves 140 and 142 through one cycle of movement while the pistons 120 are moving through a four consecutive 180° strokes of movement.

The sequence of the cycle of movements of the valves 140 and 142 is determined by four inlet opening and closing cam portions, designated by the numeral 146 with added letter A through D respectively.

Formed on the camshaft 144 in axially spaced relation in alignment with and to engage the stem end of the four inlet valves 140 are four outlet opening and closing cam portions, designated by the numeral 148 with added letters A through D respectively. The cam portions 148 are formed on the camshaft 144 in axially spaced relation in alignment with and to engage the stem ends of the four outlet valves 142. Each cam portion 146 and 148 is configured to provide (1) leading surfaces which when engaged with a valve stem moves the valve 142 or 144 in opening relation to the associated opening, (2) a trailing surface which when engaged with a valve stem moves the valve 140 or 142 into sealing relation to the associated opening and (3) a central surface between the leading and trailing surfaces which when engaged with a valve stem holds the valve 140 or 142 in opening relation to the associated opening. The four stroke cycle of movement of each piston 120 controlled by the rotation of the output shaft 124 through two revolutions are as shown in FIGS. 6-9 and indentified in order as an intake stroke, a compression stroke, a power drive stroke, and an exhaust stroke. The coordinated movements of each inlet valve 140 and outlet valve 142 during the four identified piston strokes of the associated piston 120 is as follows (1) during the intake stroke inlet valve 140 is opened and outlet valve 142 is closed (2) during the compression and power drive strokes both valves 140 and 142 are closed and during the exhaust stroke inlet valve 140 is closed and outlet valve 142 is opened. The exact timing of the required valve movement within the associated strokes is in accordance with known practice.

It will be understood that the four supply passages 132 are communicated with a source of filtered air similar to that shown in FIG. 3 and the four exhaust passage 136 are communicated with a muffled exhaust manifold (not shown).

The engine 110 also includes four fuel injectors, designated generally by the numeral 150 with added letters A through D respectively. The four fuel injectors 150 are of known construction and embody a known control system similar to the one shown in FIG. 4 an example, is embodied in a 4 cylinder, four cycle GM engine. Each injector 150 is communicated with a pressurized fuel containing manifold (not shown) through a opening in an upper end 152 thereof. Each upper open end 152 communicates the fuel under pressure received therein to a lower discharge nozzle 154. Each injector 150 also includes an electrically controlled valve similar to the valves between the upper ends 152 of FIG. 4 and lower nozzle 154, which allows fuel under pressure to flow from the nozzle 154, when open, and to prevent the flow of fuel under pressure from the nozzle 154 when closed. The timing between the opening of the control valve and the closing of the control valve determines the amount of fuel injected. The electrically operated control valves are operated by electrical signals from a computer similar to the computer 52 shown in FIG. 4.

In accordance with the principles of the present invention, the frame structure 116 has a passage 156 formed therein that communicates cylinder 118B to cylinder 118C (the two middle cylinders) adjacent the valve ends thereof.

A conventional distributor-spark plug ignition system is provided for the engine 110, the distributor components of which also not shown, the ignition system includes a spark plug 162 associated with cylinder 118B and spark plugs 164A and 164D associated with cylinders 18A and 18D.

In the normal operation of the engine 110, the pistons 120A and 120D in cylinders 118A and 118D have simultaneous intake strokes during which the injectors 150A and 150B inject the same amount of fuel into the air being drawn into the respective cylinder 118A or 118D. The charges of air fuel mixture within the cylinders 118A and 118D established at the end of the simultaneous intake strokes of pistons 120A and 120D therein are compressed during the following simultaneous compression stroke of the pistons 120A and 120D into compressed charges of mixed fuel and air. When the spark plugs 164A and 164D are simultaneously activated, the pistons 120A and 120D will be moved through their simultaneous power drive strokes, followed by simultaneous exhaust strokes.

In normal operation, the injectors 150B and 150C in cylinders 118B and 118C are also injected with the same amount of fuel as cylinders 118A and 118D. When pistons 120B and 120C establish charges of compressed air and fuel mixture therein at the end of the simultaneous compression strokes thereof, the charges of compressed air and fuel mixture in cylinders 118B is ignited by spark plug 162 and the resulting ignition creates a pressurized flame in cylinder 118B which passes through passage 156 into cylinder 118C to ignite the charge of compressed air and fuel mixture in cylinder 118C.

In accordance with the principles of the present invention, during the fuel saving cycle of a fuel saving mode, the injector 150C associated the cylinder 118C does not go through an injection cycle but injector 150B does. Thus, when the pistons 120B and 120C reach the end of their simultaneous compression strokes, cylinder 118B will have established therein a charge of compressed air and fuel mixture while cylinder 118C will have established therein a charge of compressed air.

When the charge of compressed air and fuel mixture in cylinder 118B is ignited by spark plug 164B, the high pressure conditions created as a result thereof are immediately communicated by means of passage 156 with the charge of compressed air in cylinder 118C to raise the pressure acting on pistons 120C during the simultaneous power drive stroke thereof with piston 120B.

Since the pistons 120A and 120D together are 180° out of phase with the pistons 120B and 120C together. The simultaneous power drive strokes of both pairs will fall within one rotation of the output shaft 124. It will be remembered that the opposite duplicate bank is also 180° out of phase with the first bank so that the simultaneous power drive strokes of both duplicate pairs in the duplicate bank will occur within the other full rotation of the out put shaft 124 in each two rotational cycle. Thus, a pair of simultaneous power drive strokes will be applied to the shaft 124 during each half revolution thereof. In normal mode operation all of the power drive strokes will be of the same force. During the fuel saving mode of operation, the outer pair of pistons in each bank have equal power drive strokes equal to those of normal operation. However, the power drive stroke of the inner pair of each bank are powered by one half the fuel and go through twice the expansion.

It should be noted that with spark ignition in normal mode operation, the time delay between the ignition in the first cylinder and the time the ignition of the first takes to ignite the second could move peak pressures in the second nearer the most efficient crank angle.

It is also within the contemplation of the present invention to provide either a one bank or two bank internal combustion engine which operates at all items within the gas saving cycle of the present invention.

Figure 10:
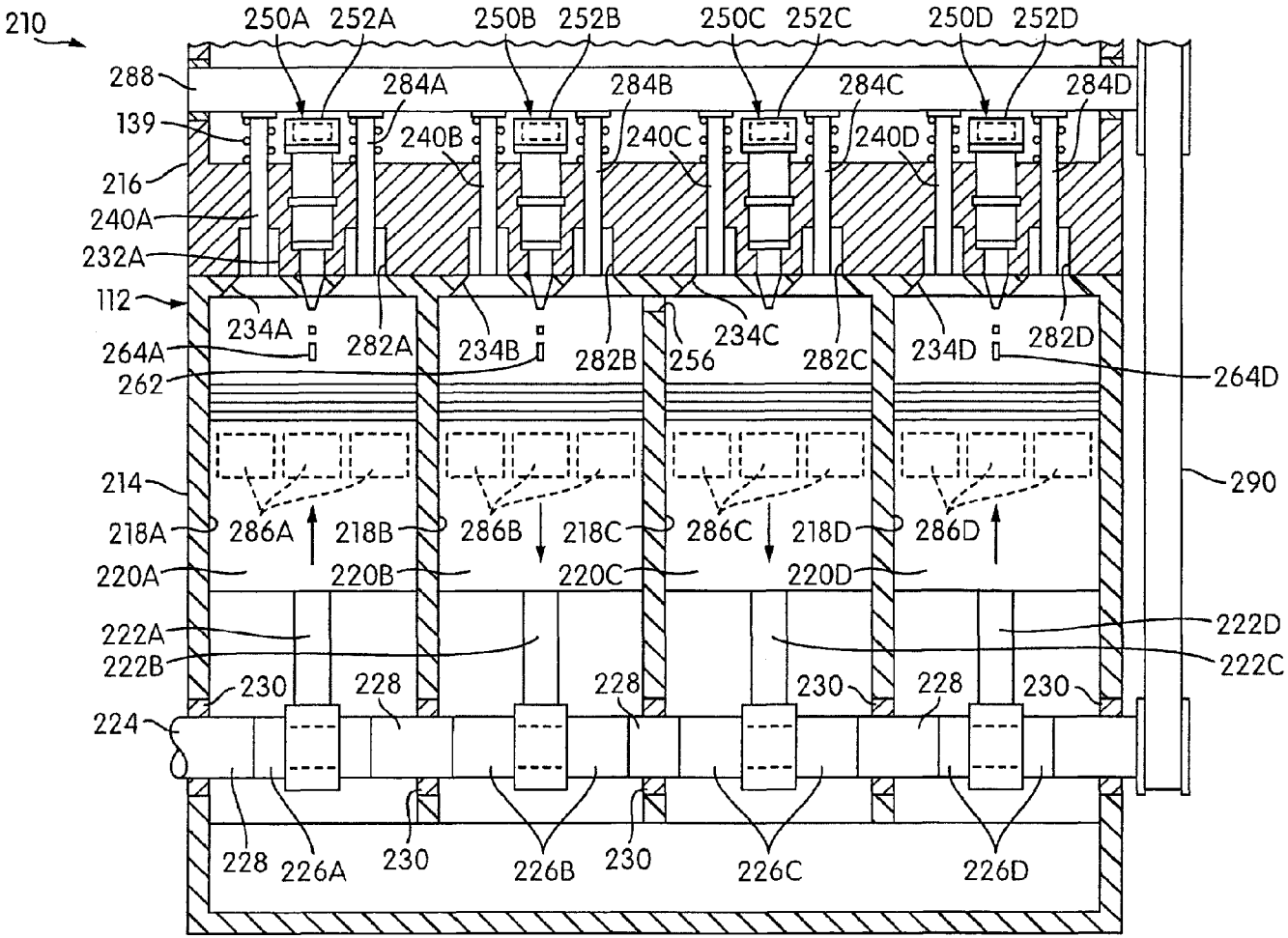
FIG. 10 is a horizontal sectional view of a spark ignited engine embodying the principles of the present invention which operates on a two stroke cycle.

Referring now to FIG. 10 there is shown therein an engine 210 embodying the principles of the present invention which operates on a two stroke cycle rather than on a four stroke cycle. As shown similar parts have been given numbers with a leading 2 rather than the leading 1 as in FIGS. 5-9 so that the description will be concerned only with the differences.

First, the exhaust outlets 136 are changed to inlets designed by the numeral 282 with added letters A through D respectively. Thus outlet valves 142 A-D become inlet valves 254A-D that are moved simultaneously with the inlet valves 240 A-D respectively.

Second, the cylinders 220 are formed with a series of annularly spaced outlets, designated by the numeral 286 with added letters A through D respectively, as before, the inlets 232 and 282 communicate with a filtered air manifold (source not shown) and the outlets 286 communicate with a muffled exhaust manifold not shown.

The four piston and cylinder assemblies of the engine 210 are provided with a different cam shaft 288 for controlling each assembly to go through a two stroke cycle of movement during each revolution of output shaft 224. The rotational motion transmission assembly 145 is changed to effect this change as indicated at 290 so that the rotation of the cam shaft 288 is driven through one revolution during each rotation of the output shaft 224. Each cycle includes a gaseous charge exchange portion which establishes that each piston has an appropriate charge of compressed gas therein either an air-fuel mixture or air without fuel mixed therein at the end of a first compression stroke. The charges of compressed air-fuel mixture are then ignited to begin a return power drive stroke at the end of which the gaseous charge exchange portion begins when the associated piston 220 moves below the outlets 286 and inlet valves 243 and 284 are opened. The gaseous charge exchange portion ends with the movement of the piston 220 upwardly beyond the outlets 286 after which the rest of the stroke is compression.

The crank shaft 224 is the same as far as piston movements are concerned. The piston 220B and 220C move together while pistons 220A and 220D move together. With the cycle the same and thereof 180° out of phase with respect to simultaneous cycles of pistons 220B and 220C.

FIG. 10 shows the position of the parts with the pistons at respective mid positions of movement corresponding to the middle of the power drive strokes of pistons 220B and 220C and the middle of the compressing strokes of piston 220A and 220D, with all valves closed. When the engine 210 with spark ignition is in a fuel saving mode, the two middle piston and cylinder assemblies B and C go through a gas exchange portion together but only cylinder 218B receives a fuel charge during gas exchange so that at the end of the compression stroke cylinder 218B has a charge of compressed air-fuel mixture therein while cylinder 218C has a charge of compressed air therein. As before the ignition of the charge in cylinder 218B is communicated through passage 256 to raise the air compression pressure in cylinder 218C and effect the power drive stroke thereof together with the drive stroke of piston 220B.

The same cycle is carried out in cylinders 220A and 220D only 180° out of phase with respect to one another. The operation in normal mode operation is that both cylinders receive a charge of air-fuel mixture which are both ignited as before. The engine 210 has the advantage that a double power drive stroke is applied every half turn of the output shaft 224. The fuel saving mode achieves the advantage previously noted.

The computer 52 used with respect to all of the engine embodiments disclosed above (or any others) may be reprogrammed or configured differently. Preferably, the reprogramming or other operational configuration may involve the situation when the computer 52 is operable to control the injectors in accordance with the fuel saving mode of operation on a relatively continuous basis. For example, when the computer 52 senses the actuation and continued operation of the cruise control, the computer 52 is also operable to change which one of the two piston and cylinder assemblies constitutes the one cylinder which has the ignitable fuel-air mixture therein. The change is preferably in accordance with a predetermined pattern, such as, for example, an operative alternation between the two piston and cylinder assemblies. The alternations may be between equal or substantially equal periods of time for delivering the ignitable fuel-air mixture individually to each cylinder. This functionality may reside in the computer circuitry (a hardware implementation) or computer executable instructions (a software implementation), or any combination thereof. The computer may be a general purpose computer, an ASIC, or any other suitable processor.

The foregoing illustrated embodiments have been provided solely to illustrate the structural and functional principles of the present invention, and are not intended to be limiting. To the contrary, the present invention encompasses all modifications, alterations, substitutions, and equivalents within the spirit and scope of the appended claims.

What is claimed:

1. An internal combustion engine for propelling an automotive vehicle comprising:

a frame structure, a pair of piston and cylinder assemblies mounted on said frame structure including two side by side cylinders and pistons movably mounted in said cylinders for simultaneous movements through repetitive cycles, each including simultaneous compression strokes and immediately following simultaneous power drive strokes, an output shaft connected with said pistons so as to be moved by said pistons through a predetermined number of rotational movements during each cycle of movement of said pistons, a passage between said side by side cylinders to communicate the cylinders;

a fuel injection system including an injector operatively associated with each of said piston and cylinder assemblies, said fuel injection system being constructed and arranged in (a) a first mode of operation wherein fuel is injected into both said side by side cylinders to establish at the beginning of the simultaneous power drive strokes of the pistons of both cylinders a charge of ignitable compressed fuel and air mixture in each of said cylinders, and both mixtures are ignited to affect simultaneous internally fired power drive strokes of both pistons, and (b) a second mode of operation wherein the fuel is injected into only one of said side by side cylinders to establish at the beginning of the simultaneous power drive strokes of the pistons of both cylinders a charge of ignitable compressed air fuel mixture in said one cylinder and a charge of unignitable compressed air in the other cylinder, and the mixture in said one cylinder is ignited with the resultant pressure therein shared by said passage with the other cylinder to affect simultaneous shared power drive strokes of both pistons, said fuel injection system further including a controller operable in response to a predetermined operating condition of the automotive vehicle to maintain said internal combustion engine continuously in said second mode of operation and while continuously in said second mode of operation changing in accordance with a predetermination pattern which one of the two piston and cylinder assemblies constitutes the one cylinder which has the ignition fuel-air mixture therein.

2. An internal combustion engine as defined in claim 1 wherein said pair of piston and cylinder assemblies form one bank of piston and cylinders disposed on one side of said output shaft and a second bank of a second pair of piston and cylinder assemblies constructed and arranged similar to said first pair are disposed on an opposite side of said output shaft and connected therewith so that the repetitive movement cycles of the pistons thereof are disposed 180° out of phase with respect to the repetitive movement cycles of said first mentioned pistons.

3. An internal combustion engine as defined in claim 1 wherein the connection between said pistons and said output shaft is constructed and arranged so that the output shaft is moved through one rotational movement by each movement cycle or said pistons.

4. An internal combustion engine as defined in claim 3 wherein said fuel injection system is constructed and arranged to establish the charges of ignitable compressed air fuel mixture and the ignition thereof by said injectors injecting fuel into a charge of compressed air at a compression ignition condition.

5. An internal combustion engine as defined in claim 1 wherein the connection between said pistons and said output shaft is constructed and arranged so that the output shaft is moved through two rotational movements by each movement cycle of said pistons, each cycle including simultaneous exhaust strokes following the simultaneous power drive strokes and simultaneous intake strokes before the simultaneous compression strokes.

6. An internal combustion engine as defined in claim 1 wherein said fuel injection system includes spark ignitors constructed and arranged to ignite each charge of ignitable air-fuel mixture in said cylinders by a spark, wherein in said first mode said spark ignitor for one of said cylinders is operated to ignite the charge of ignitable air-fuel mixture therein, and the charge of ignitable air-fuel mixture in said other cylinder is ignited by pressurizing flame passing from the ignition in said one of said cylinders through said passage to ignite the charge of ignitable compressed air-fuel mixture in the other of said cylinders during said first mode of operation.

7. An internal combustion engine as defined in claim 6 wherein each piston and cylinder assembly consists of a single piston in a single cylinder.

8. An internal combustion engine as defined in claim 6 wherein each piston and cylinder assembly includes a pair of opposed piston movable toward and away from one another in one cylinder.

9. An internal combustion engine as defined in claim 8 wherein each piston and cylinder assembly of said pair of assemblies includes a second piston in each cylinder connected with said output shaft to (1) move toward the output shaft as the associated piston moves away from the output shaft and (2) move away from the output shaft as the associated piston moves toward the output shaft.

10. An internal combustion engine as defined in claim 1 wherein each pair of piston and cylinder assembles has a corresponding opposite pair of piston and cylinder assemblies with the same movement cycles connected to said output shaft so as to be out of phase 180° with respect to movement cycle of the corresponding opposite pair, each corresponding opposite pair of assemblies having a passage between the cylinders thereof.

11. An internal combustion engine defined in claim 1 wherein said pair of piston and cylinder assemblies constitute an inner two of four in line piston and cylinder assemblies which also include two outer piston and cylinder assemblies including two outer cylinders and two outer pistons mounted in said two outer cylinders for simultaneous movements through repetitive cycles, each including simultaneous compression strokes and immediately following simultaneous power drive strokes, said two outer pistons being connected to said output shaft so that the repetitive movement cycles thereof are 180° out of phase with respect to the repetitive movement cycles of said first mentioned pistons, said fuel injecting system including two outer fuel injectors operately associated with said two outer cylinders for causing simultaneous ignition of charges of compressed air-fuel mixture therein to move the two outer pistons through simultaneous drive strokes during each movement cycle thereof.

12. An internal combustion engine as defined in claim 11 wherein said four in line piston and cylinder assemblies form one bank of assemblies on one side of said output shaft and a second bank of assemblies of similar construction and arrangement are disposed on an opposite side of said output shaft.

13. A method of operating an internal combustion engine constituting the propulsion power of an automotive vehicle in which it is installed in two modes of operations to accommodate different conditions during use; the engine including two adjacent piston and cylinder assemblies connected with crank shaft structure so that during a predetermined number of rotations of the crank structure the pistons of both assemblies are moved simultaneously through repetitive cycles each of which includes a compression stroke and an immediately following a power drive stroke, and a passage between said side by side cylinders to communicate the cylinders; the method comprising:

selectively establishing during a time in each cycle before the power drive stroke (1) in a first mode of operation an ignitable charge of compressed air-fuel mixture in both cylinders of both assemblies or (2) in a second mode of operation an ignitable charge of compressed air-fuel mixture in the cylinder of a first assembly and a charge of compressed air in the cylinder of the second assembly;

igniting each ignitable charge in the cylinders of the assemblies so that (1) during the first mode of operation the pistons of both assemblies as a result of the ignition are moved simultaneously in both cycles through successive internally fired power drive strokes of the cycles of both pistons and (2) during the second mode of operation the piston of the first assembly is moved as the result of the ignition of the charge in the first cylinder through successive power drive strokes of successive cycles and the piston of the second assembly is moved simultaneously as a result of communicating the cylinder of the first assembly with the cylinder of the second assembly via said passage so that the rise in pressure resulting from the ignition in the first cylinder is transmitted to the second cylinder to move the piston of the second assembly through the power drive stroke of each cycle to affect simultaneous shared power drive strokes of both pistons; and during the second mode of operation changing which of the pair of assemblies is said first assembly receiving the fuel-air mixture in its cylinder and which is said second assembly receiving the compressed air and rise in pressure via said passage between both of said assemblies in accordance with a predetermined pattern.

14. A method as defined in claim 13, wherein the predetermined pattern is an operative alternation between the two piston and cylinder assemblies.

15. A method as defined in claim 13 wherein the ignition of the charges of air, fuel mixture in both modes of operation is accomplished by compression ignition in response to the injection of fuel into a charge of compressed air.

16. A method as defined in claim 13 wherein the ignition of the charge of compressed air-fuel mixture in the cylinder of the first assembly is accomplished by spark ignition in both modes of operation and in the first mode of operation the ignition of the charge of compressed air-fuel mixture in cylinder of the second assembly is accomplished by communicating the ignition in the first cylinder with the cylinder of the second assembly and allowing a pressurized flame resulting from the ignition in the first cylinder to ignite the charge of compressed air-fuel mixture in the cylinder of the second assembly.

* * * * *